US011473340B2

(12) United States Patent
Digmann

(10) Patent No.: US 11,473,340 B2
(45) Date of Patent: Oct. 18, 2022

(54) DOOR STOP MECHANISM

(71) Applicant: Franklin & Jackson Group, LLC, Dubuque, IA (US)

(72) Inventor: Charles J. Digmann, Dubuque, IA (US)

(73) Assignee: FRANKLIN & JACKSON GROUP, LLC, Dubuque, IA (US)

( * ) Notice: Subject to any disclaimer, the term of this patent is extended or adjusted under 35 U.S.C. 154(b) by 579 days.

(21) Appl. No.: 16/373,080

(22) Filed: Apr. 2, 2019

(65) Prior Publication Data

US 2019/0301205 A1 Oct. 3, 2019

Related U.S. Application Data

(60) Provisional application No. 62/651,950, filed on Apr. 3, 2018.

(51) Int. Cl.

| | |
|---|---|
| ***E05C 17/60*** | (2006.01) |
| ***E05B 65/08*** | (2006.01) |
| ***E05C 19/00*** | (2006.01) |

(52) U.S. Cl.

CPC ..... *E05B 65/0888* (2013.01); *E05C 19/003* (2013.01); *E05Y 2900/132* (2013.01)

(58) Field of Classification Search

CPC .... Y10S 292/15; Y10S 292/25; Y10S 292/46; Y10T 292/0863; Y10T 292/0864; Y10T 292/0886; Y10T 292/0887; Y10T 292/28; E05B 65/0888; E05C 19/003

USPC ..... 49/449

See application file for complete search history.

(56) References Cited

U.S. PATENT DOCUMENTS

| | | | | |
|---|---|---|---|---|
| 415,605 A | | 11/1889 | Blatchford | |
| 752,476 A | | 2/1904 | Stearns | |
| 889,453 A | * | 6/1908 | Gerson | E05B 65/0864 292/60 |
| 1,086,749 A | * | 2/1914 | Brenneman | E05C 1/10 292/175 |
| 1,302,409 A | * | 4/1919 | Murphy | E05B 65/0864 49/449 |
| 1,379,997 A | * | 5/1921 | Macminn | E05B 65/087 70/99 |
| 1,723,007 A | * | 8/1929 | Bittorf | E05B 17/2076 292/57 |
| 3,103,713 A | * | 9/1963 | Ahlgren | E05B 65/0876 49/413 |
| 3,816,967 A | * | 6/1974 | Littrell | E05B 65/0888 49/449 |
| 3,997,200 A | * | 12/1976 | Brown | E05B 65/087 292/145 |
| 4,017,105 A | * | 4/1977 | Paxton | E05B 65/0894 292/288 |

(Continued)

*Primary Examiner* — Carlos Lugo

(74) *Attorney, Agent, or Firm* — Shuttleworth & Ingersoll, PLC; Brett Papendick

(57) ABSTRACT

A door stopping mechanism for a sliding glazing patio door or like, independent in construction from the sliding glazing for which it is stopping, includes a vertical and horizontal component. The horizontal component is within the track of the door, while the vertical component is selectively attached to the sliding member. The mechanism is changeable from a locked to unlocked position by manipulation by a user at mid-height of the door, and at least one of the locked or unlocked positions is maintained by gravity.

16 Claims, 12 Drawing Sheets

(56) References Cited

U.S. PATENT DOCUMENTS

| | | | | | |
|---|---|---|---|---|---|
| 4,073,522 | A * | 2/1978 | Tierney | E05B 65/0888 | 292/262 |
| 4,248,461 | A * | 2/1981 | Stevens | E05B 45/12 | 292/218 |
| 4,263,795 | A | 4/1981 | Van Gompel | | |
| 4,437,694 | A * | 3/1984 | Lillo | E05B 65/0888 | 292/235 |
| 4,475,313 | A | 10/1984 | Governale | | |
| 4,635,976 | A * | 1/1987 | Sigler | E05B 65/0847 | 292/57 |
| 4,759,575 | A * | 7/1988 | McKnight | E05B 53/001 | 292/144 |
| 5,285,596 | A * | 2/1994 | Kinsey | E05B 65/0876 | 16/81 |
| 5,499,517 | A * | 3/1996 | McCraw | E05B 65/0007 | 16/86 R |
| 6,415,565 | B1 * | 7/2002 | Sosa | E05B 17/2065 | 292/4 |
| 6,655,720 | B2 | 12/2003 | Rampen | | |
| 9,062,479 | B2 * | 6/2015 | Wolf | E05B 65/0888 | |
| 9,309,696 | B2 | 4/2016 | Friese et al. | | |
| 9,441,414 | B2 | 9/2016 | Baczuk et al. | | |
| 2005/0262772 | A1 * | 12/2005 | Zimmerman | E06B 3/4609 | 49/449 |
| 2010/0147042 | A1 | 6/2010 | Chen | | |
| 2012/0227329 | A1 * | 9/2012 | Vosburg | E05D 15/08 | 49/449 |
| 2013/0199099 | A1 * | 8/2013 | Ryden | E05F 1/16 | 49/449 |

* cited by examiner

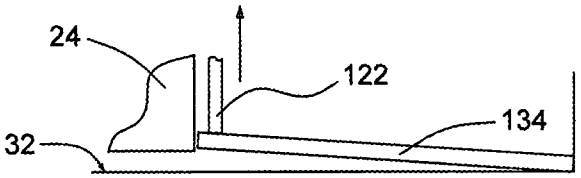
Fig. 11
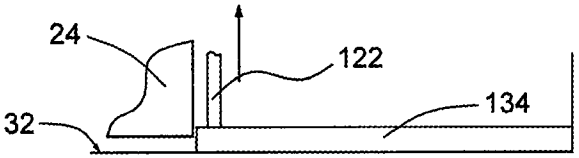
Fig. 13
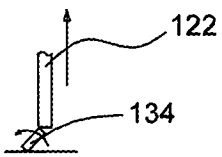
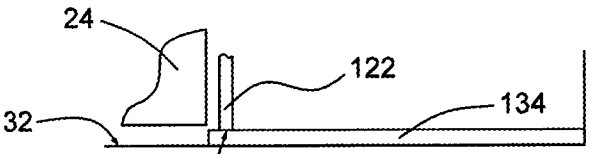
Fig. 10
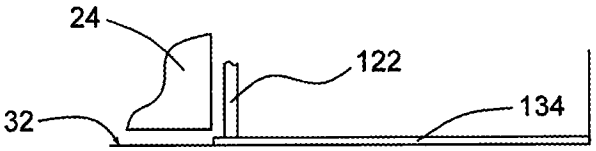
Fig. 12
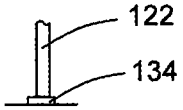

DOOR STOP MECHANISM

CROSS-REFERENCE TO RELATED APPLICATIONS

The present application claims priority to provisional patent application 62/651,950 which was filed on Apr. 3, 2018, and is hereby expressly incorporated by reference in its entirety.

BACKGROUND OF THE INVENTION

There are a variety of locking or stopping mechanisms for a standard sliding fenestration used in housing. The mechanisms can be a simple as a removable bar that prevents the sliding portion of the door from moving. In such a mechanism, a person must bend over and remove the bar to open the door. While there are other more complicated mechanisms, the prior art requires the user to bend over or reach upward to manipulate these more sophisticated mechanisms.

SUMMARY OF THE INVENTION

The invention is a stopping mechanism for a sliding glazing patio door or like, independent in construction from the sliding glazing for which it is stopping. The stopping mechanism includes a stop rod which is part of a stop body assembly; and a stop bar. Additionally, a rotation stop can be added to inhibit rocking of the sliding portion of the patio door; or a wireless remote activation mechanism can be added. The stop body assembly is mounted to the sliding glazing frame and the stop bar is positioned next to and below (or above) the sliding glazing frame, depending on the specific embodiment. The vertical frame is part of the supporting frame assembly that supports the sliding door during operation and opposite the normal vertical strike frame or locking side. When activated to a locked position, the stop rod stops the movement of the sliding glazing via contact with the stop bar.

The stop bar can be made from any material of wood, composite, metal, plastic, etc. The stop body assembly can be constructed in multiple ways, which include a stop body and a stop rod. The stop body can be made from any material of wood, composite, metal, plastic, etc. The stop rod can be metal or composite plate, rod or the like. The stop body, the stop bar and the stop rod are rigid and non-deformable in construction. The stop body supports the stop rod. The stop rod can move independent of the stop body or the stop rod can move with the stop body. The stop rod or the stop body can use the natural force of gravity or require a force to be moved into the position of operation. The stop body assembly, the stop bar and the rotation stop may or may have supporting components as shown in the figures.

BRIEF DESCRIPTION OF THE DRAWINGS

FIG. 10 is a front view of the second embodiment in the unlocked position;

FIG. 11 is a front view of the second embodiment in the locked position;

FIG. 12 is a front view of an alternate second embodiment in the unlocked position;

FIG. 13 is a front view of the alternate second embodiment in the locked position;

DETAILED DESCRIPTION

Figures 1, 2, 3, 4:
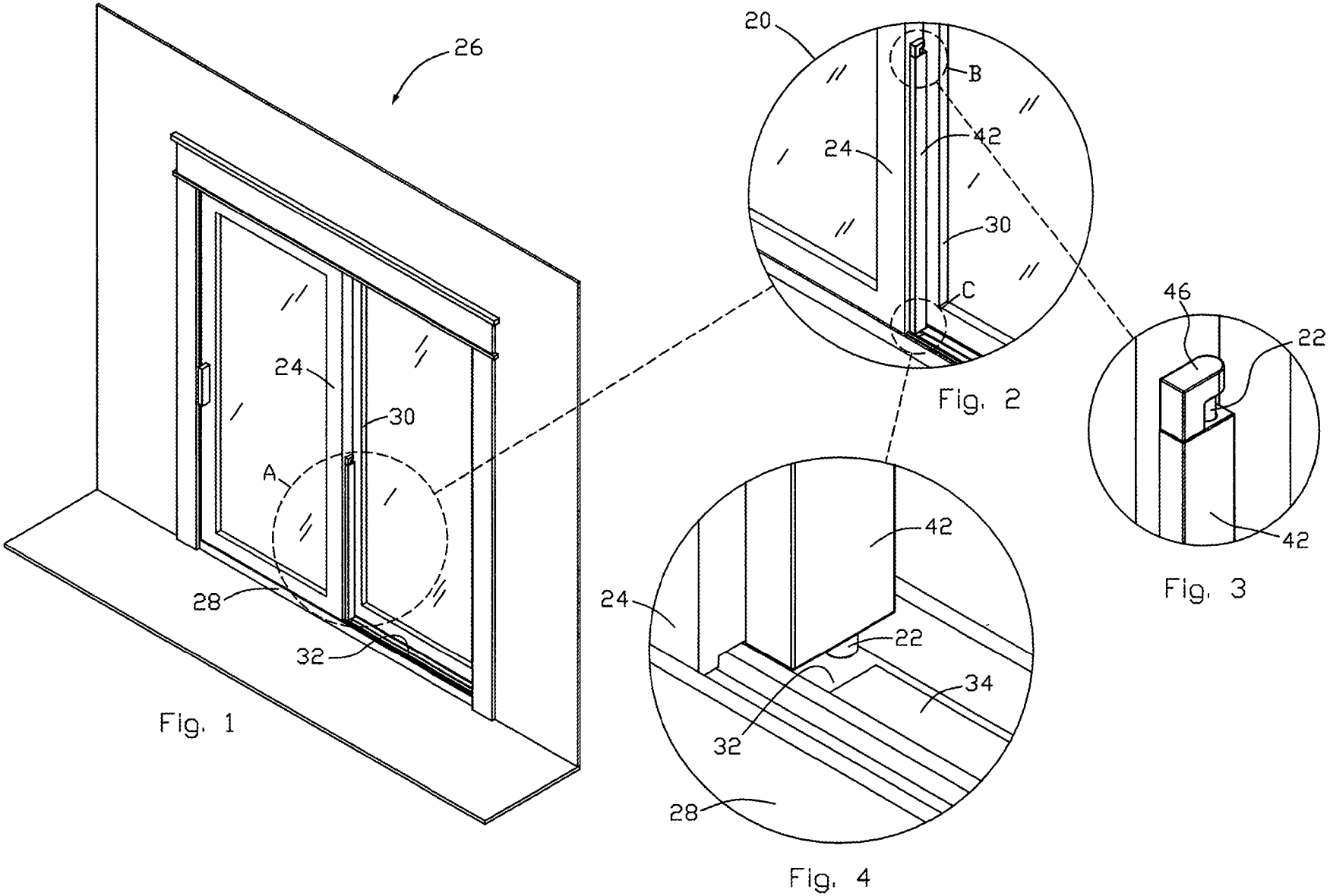
FIG. 1 is a perspective view of a first embodiment of the invention mounted on a patio door.
FIG. 2 is perspective view of section A of FIG. 1.
FIG. 3 is a perspective view of section B of FIG. 2.
FIG. 4 is a perspective view of section C of FIG. 2.

Now referring to the drawings, FIGS. 1-7 show a first embodiment of the door stop mechanism 20. The door stop mechanism 20 comprises a stop rod 22 which is vertical and selectively attached to the sliding member 24 of a sliding door 26. The sliding door 26 comprises the sliding member 24, a frame 28, a stationary member 30, and a track 32. The door stop mechanism 20 further comprises a stop bar 34 which is placed horizontally within the track 32. The interaction between the stop rod 22 and the stop bar 34 determine whether the door stop mechanism 20 is in a locked or unlocked position. When the stop rod 22 is in a first position, the door stop mechanism 20 is in an unlocked position;

while when the stop rod 22 is in a second position, the door stop mechanism 20 is in a locked position. In the unlocked position, the stop rod 22 is raised such that a second end 36 of the stop rod 22 can slide over a top 40 of the stop bar 34. In the locked position, the stop rod 22 is lowered such that the second end 36 of the stop rod 22 is prevented from sliding over the stop bar 34.

Figure 7:
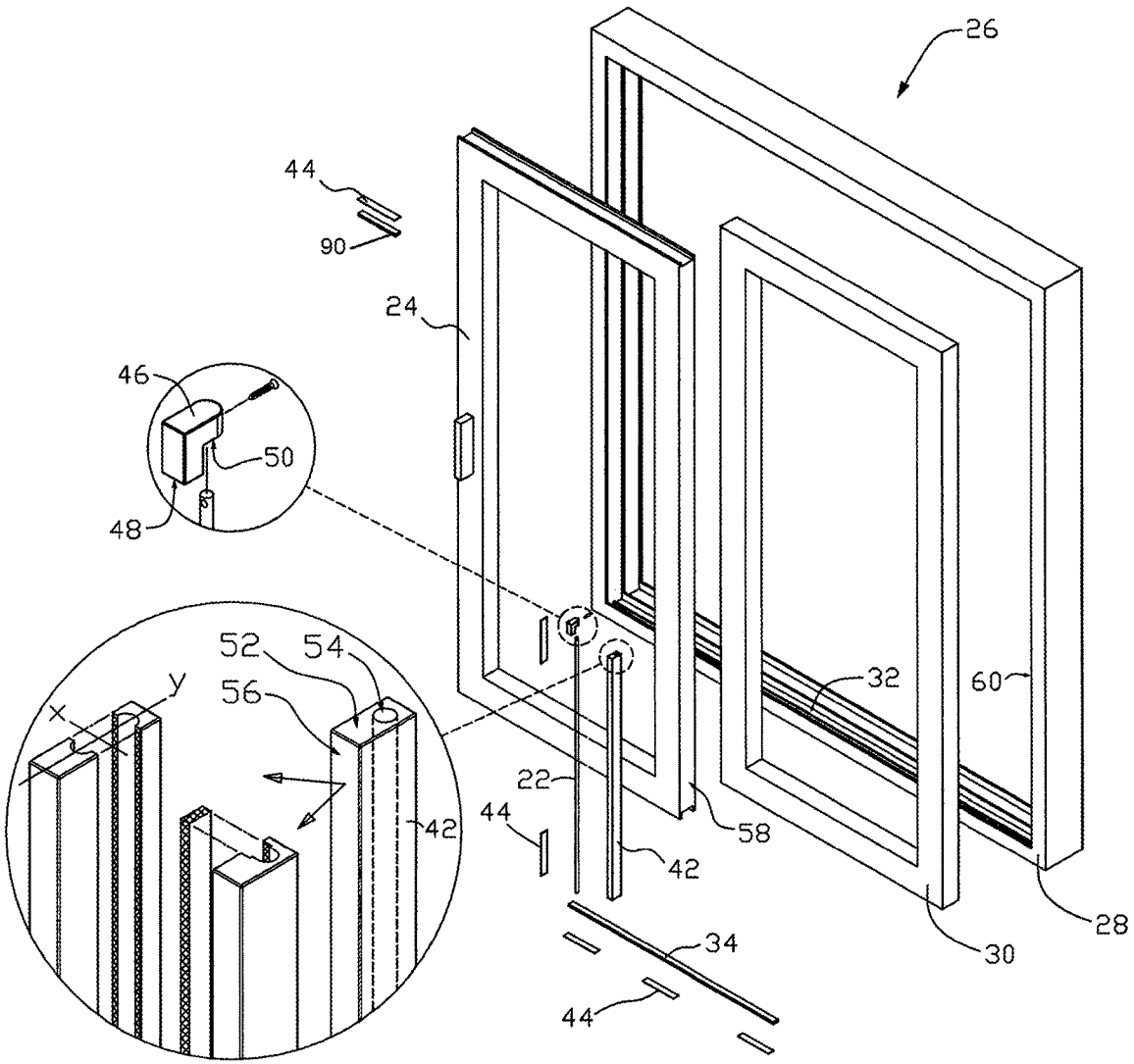
FIG. 7 is an exploded view of the first embodiment.

Preferably, the first embodiment of the door stop mechanism 20 comprises a stop body 42 that serves as a housing that at least partially contains a portion of the stop rod 22. The stop rod 22 is movable within the stop body 42. The stop body 42 is attachable to the sliding member 24 via fasteners. Multiple types of fasteners can be used. In lieu of fasteners, the preferred embodiment utilizes a PSA tape 44, as shown in FIG. 7, can be utilized to attach the stop body 42 to the sliding member 24. The stop rod 22 is at least partially held within a channel 54 on a side 56 of the stop body 42. Accordingly, in the preferred embodiment of the door stop mechanism 20, the stop rod 22 is located between the first side 56 of the sliding member 24 and the channel 54.

Figure 30:
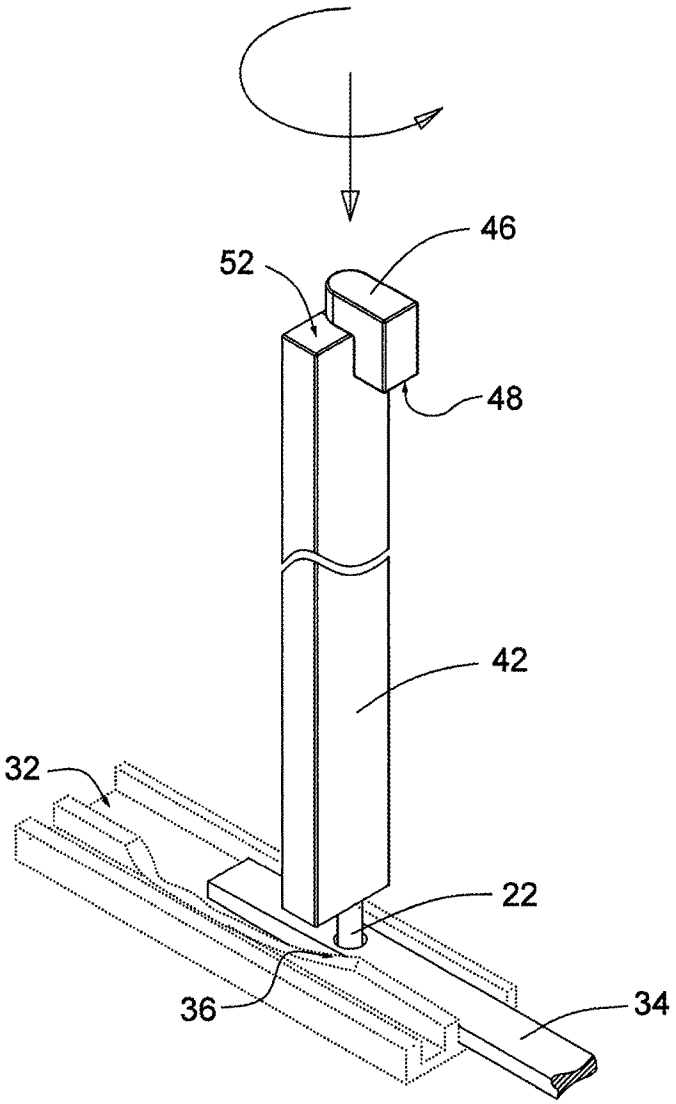
FIG. 30 is a perspective view showing the rod in the opening such that the sliding member can be in a partially open position.
Figure 29:
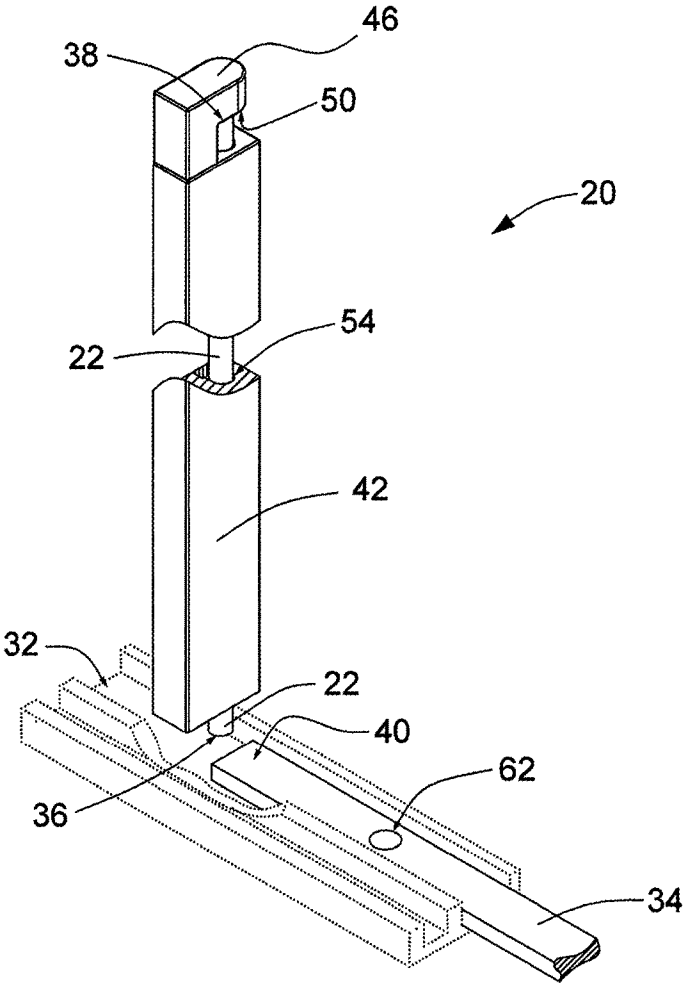
FIG. 29 is a perspective view showing a stop bar with an opening.

The stop bar 34 is placed on or within the track 32. The stop bar 34 can be substantially the length between the sliding member 24 and a first side 60 of the frame 28. The stop bar 34 contacts the first side 60 of the frame 28 which provides the stopping force for the stop bar 34. Alternatively, the stop bar 34 can be fastened to the frame 28 on or within the track 32 such that a shorter stop bar 34 can be utilized. In either case, the stop bar 34 can have one or more openings 62 on the top 40 of the stop bar 34 as shown in FIGS. 29 and 30. This allows the stop rod 22 to selectively enter one of the openings 62 which then allows the sliding member to stay in a partially open position, but having the door stop mechanism 20 in a locked position.

The stop rod 22 has a first end 38 and a second end 36, preferably with a stop rod actuator 46 at the first end 38. The stop rod actuator 46 comprises a first surface 48 and a second surface 50. Preferably, the stop rod actuator 46 is L-shaped. When the door stop mechanism 20 is in the unlocked position, the first surface 48 rests on a top 52 of the stop body 42. In this unlocked position, the second surface 50 is above the first surface 48 and parallel to first surface 48. A user can rotate the stop rod actuator 46 such that the first surface 48 slides downward via gravity until the second end 36 of the stop rod 22 makes contact with the bottom of track surface 32. Accordingly, the second surface 50 comes closer to the top 52 of the stop body 42 and the second end 36 cannot slide over the stop bar 34.

Figure 5:
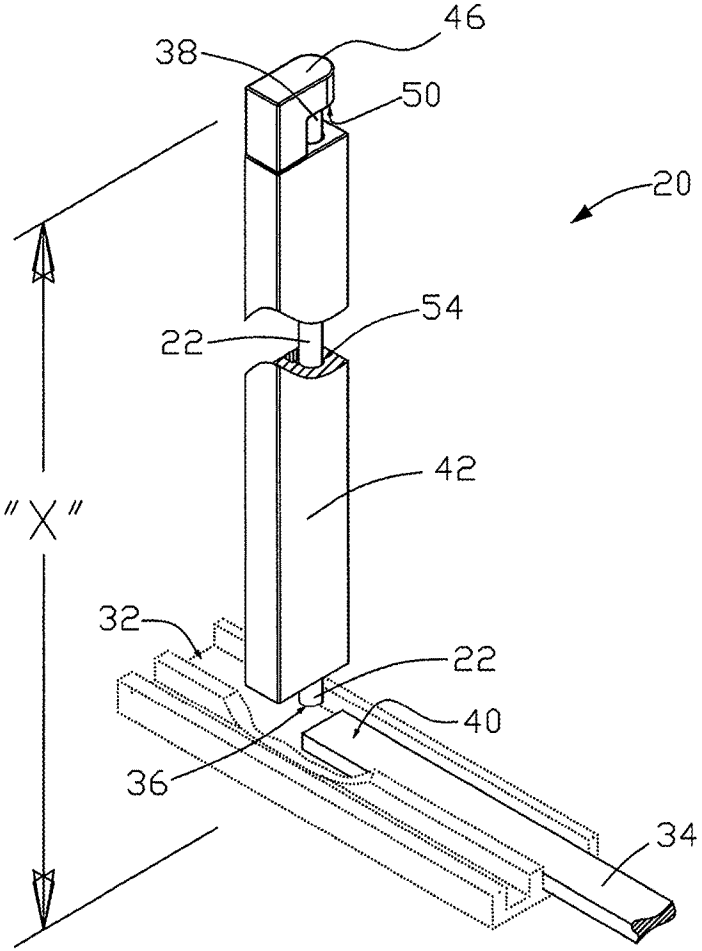
FIG. 5 is a perspective view of the first embodiment shown in an unlocked position.

In operation of the preferred embodiment of the door stop mechanism 20, the stop body 42 is mounted on the sliding member 24 as shown in FIG. 1. The stop rod 22 is placed within the channel 54 such that the first end 38 and the second end 36 protrude from the stop body 42 as shown in FIG. 5. The stop rod actuator 46 is attached to the first end 38 such that the first surface 48 is in contact with the top 52 of the stop body 42 as shown in FIGS. 3 and 5. The stop bar 34 is placed in the track 32 as shown in FIGS. 4 and 5. A height "X" from the stop bar 34 to the top of the stop rod actuator 46 is preferably between fifteen and seventy-three inches as this height makes it convenient for the user. The previously described positioning is an unlocked position also known as a first position for the stop rod 22 and a first position for the stop rod actuator 46. In the unlocked position, the stop rod 22 is slidable over the stop bar 34 as shown in FIG. 5.

Figure 6:
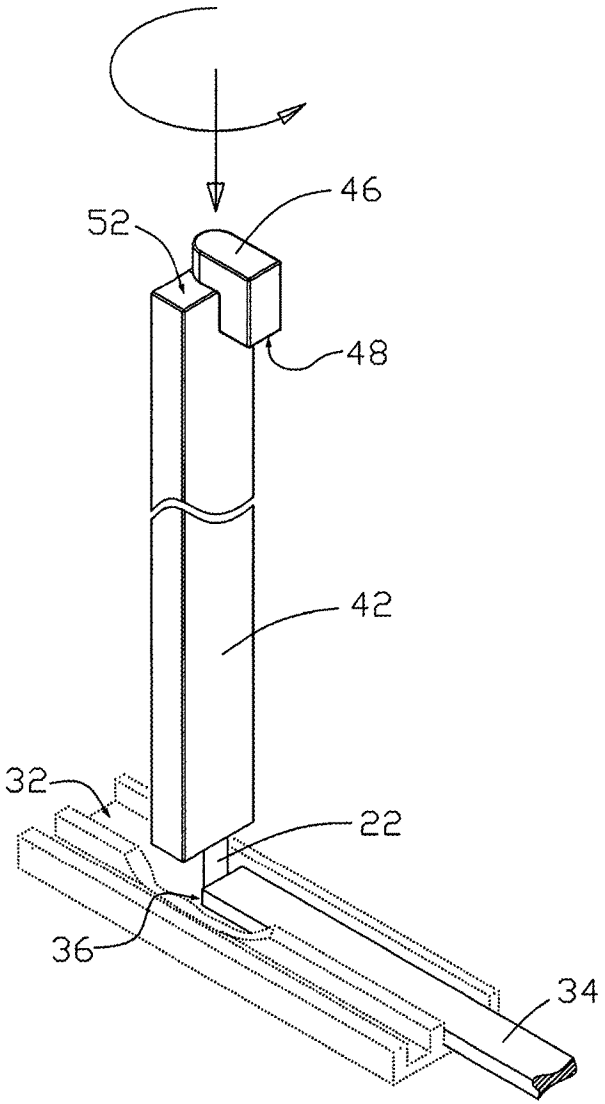
FIG. 6 is a perspective view of the first embodiment shown in a locked position.

The user can then manipulate the stop rod actuator 46 by rotating it approximately ninety degrees. At this point, the stop rod actuator 46 and the stop rod 22 drop downward until the second end 36 of the stop rod 22 makes contact with the bottom of track 32 surface, such that the second end 36 cannot slide over the stop bar 34 as shown in FIG. 6. In the preferred embodiment, the second surface 50 of the stop rod actuator 46 makes contact with the top 52 of the stop body 42 when in the locked position. However, the second surface 50 of the stop rod actuator 46 may not contact the top 52 of the stop body 42 in a different embodiment. If openings 62 are utilized on the stop bar 34, the user can manipulate the stop rod actuator 46 to selectively place the second end 36 within an opening 62. This again allows the sliding member to be held in a partially open position while in a locked position.

FIGS. 8-13 show a second embodiment of a door stop mechanism 120 that achieves a similar result to the first embodiment 20, however, the second embodiment 120 utilizes a movable stop bar 134. Additionally, the unlocked and locked positions of the second embodiment are opposite that of the first embodiment. While the first and second embodiments, 20 and 120, have many of the same parts, the main differences are the locked and unlocked positions and the movement of the stop bar 134 in the second embodiment.

Figure 8:
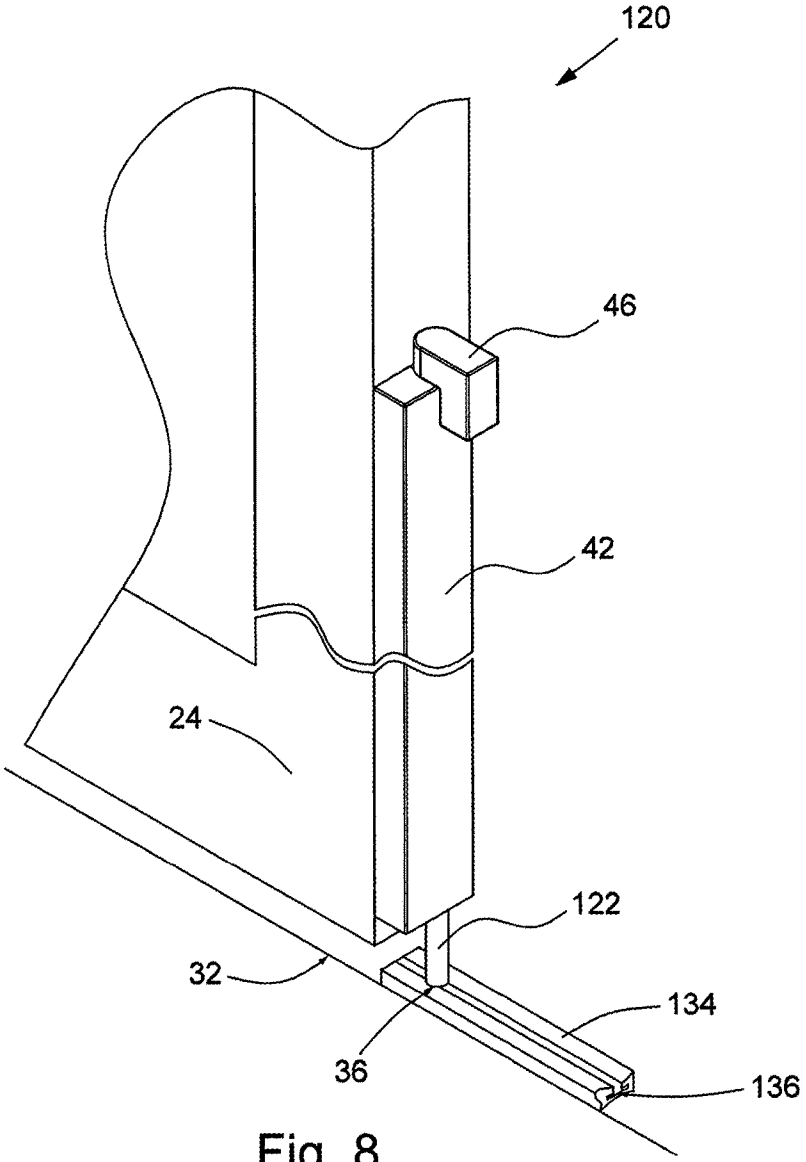
FIG. 8 is a perspective view of a second embodiment in an unlocked position.

FIGS. 8 and 10 show the second embodiment 120 in an unlocked position. The second end 36 of the stop rod 122 is connected to the stop bar 134. As shown in FIG. 8, this can be in a channel 136 of the stop bar 134. Additionally, in the unlocked position, the rod actuator 46 is in its most downward position.

Figure 9:
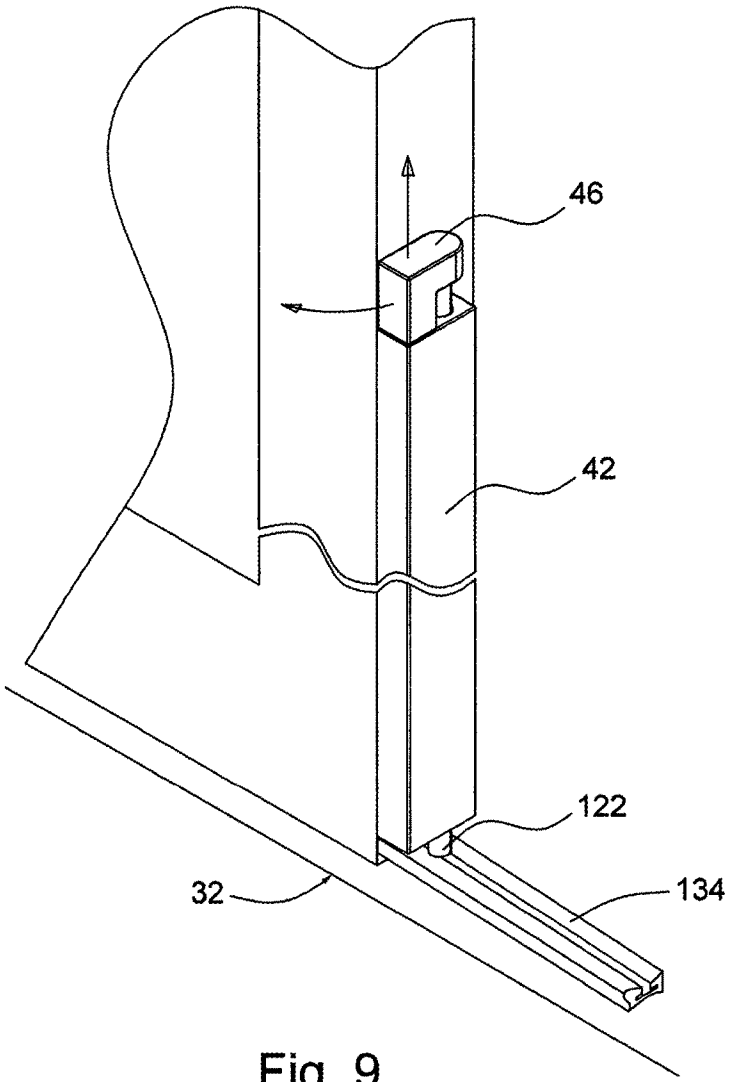
FIG. 9 is a perspective view of the second embodiment in a locked position.

FIGS. 9 and 11 show the second embodiment 120 in the locked position. In order to go from the unlocked position to the locked position, a user lifts and rotates the rod actuator 46 as shown in FIG. 9. As the rod actuator 46 is lifted, the second end 36 lifts the stop bar 134 upward. Accordingly, the stop bar 134 prevents sliding of the sliding member 24.

FIGS. 12 and 13 show the second embodiment wherein the stop bar 134 is rotated instead of lifted. This alternative works in the same way as described for the second embodiment 120 shown in FIGS. 8-11.

Figure 16:
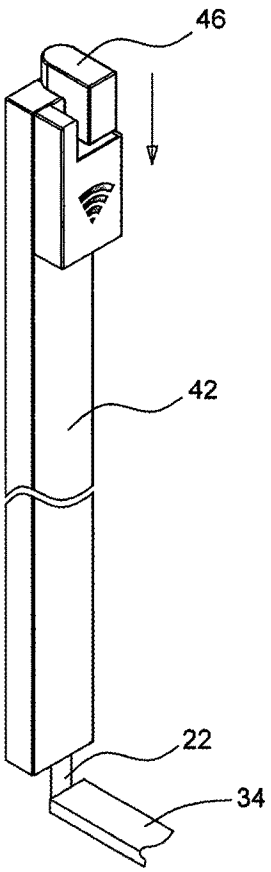
FIG. 16 is a perspective view of the third embodiment in a locked position.
Figure 15:
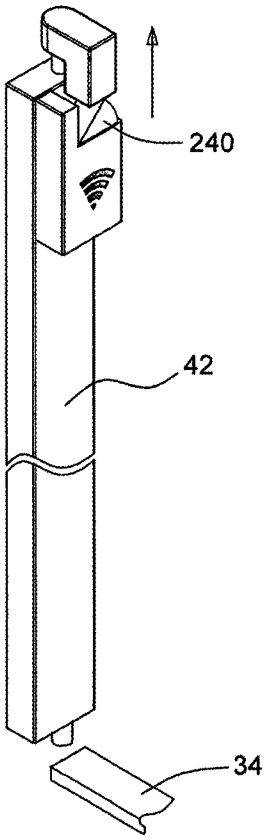
FIG. 15 is a perspective view of the third embodiment in an unlocked position.
Figure 14:
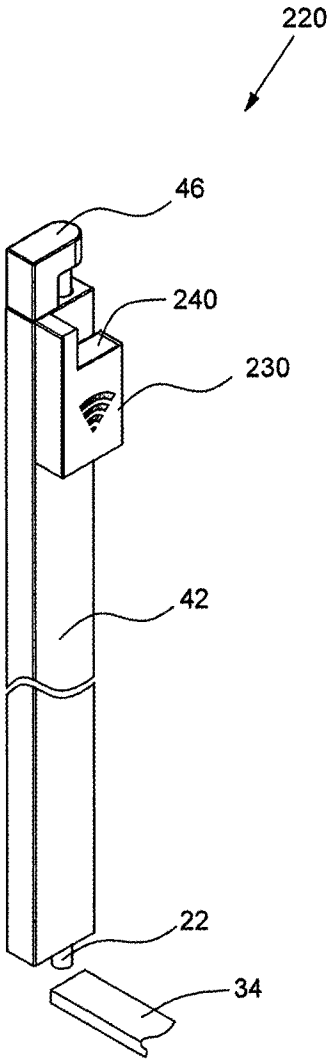
FIG. 14 is a perspective view of a third embodiment of the invention.

FIGS. 14-16 show a third embodiment of a door stop mechanism 220. The third embodiment 220 can work in a manual mode and an automated mode. The manual mode works in the exact way as the first embodiment 20, as described above. The third embodiment includes a housing 230 and a second actuator 240.

As shown in FIG. 16, the third embodiment 220 is shown in a locked position either achieved manually or automatically. The housing 230 is placed and attached on the stop body 42 and serves as a remote module. The housing 230 has the second actuator 240 that is in a downward position which is the locked position. When activated, preferably by Wi-Fi, the third embodiments second actuator 240 is directed upward as shown in FIG. 15. The upward direction of the second actuator 240 pushes the rod actuator 46 upward. Accordingly, the second end 36 of the stop rod 22 is lifted such that the second end 36 can clear the surface of the stop bar 34. This unlocked position allows the sliding member 24 and the second end 36 to glide over the stop bar 34. In order to achieve the locked position again, the process is reversed.

Figure 28:
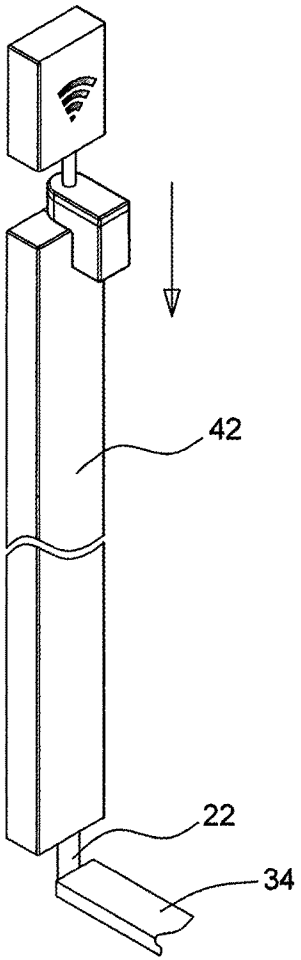
FIG. 28 is a perspective view of the third embodiment wherein the secondary actuator is above the rod actuator and in a locked position.
Figure 27:
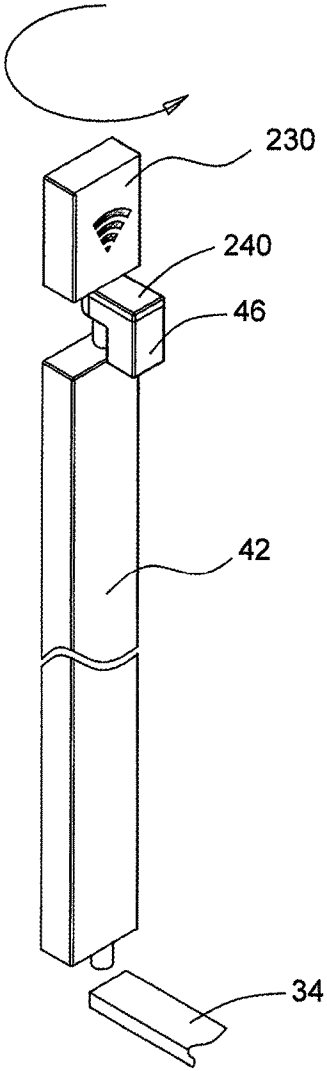
FIG. 27 is a perspective view of the third embodiment wherein the secondary actuator is above the rod actuator and has been rotated.
Figure 26:
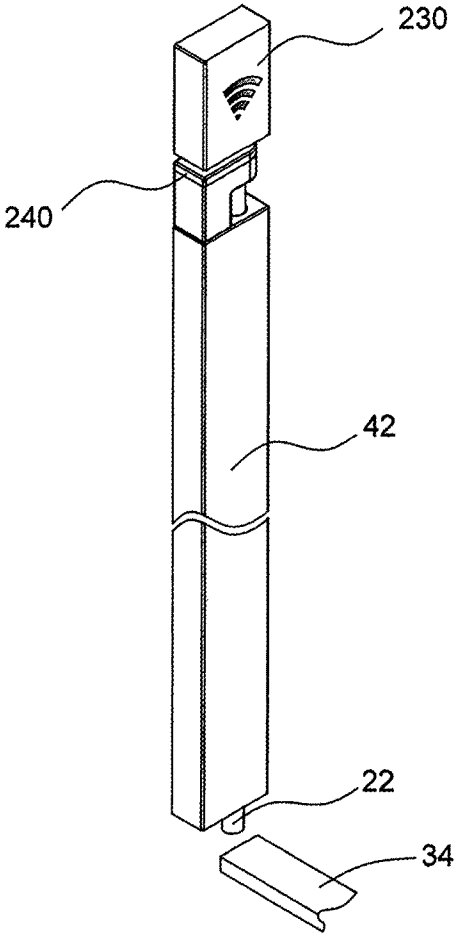
FIG. 26 is a perspective view of the third embodiment wherein the secondary actuator is above the rod actuator and in an unlocked position.

A variety of locations can be utilized for the housing 230 and the second actuator 240. For instance, in FIGS. 26-28, the housing 230 is placed above the rod actuator 46. The rod actuator 46 is attached to housing 230 via the second actuator 240. When activated by Wi-Fi, the secondary actuator 240 rotates and allows the rod actuator 46, via gravity, to go downward to a locked position. In reverse, the secondary actuator 240 brings the rod actuator 46 upward and rotates the rod actuator 46 back to the unlocked, seated position.

The rod actuator 46, when not activated via Wi-Fi, even though the rod actuator 46 is attached to the secondary actuator 240, moves freely, allowing manual operation.

Figures 17, 18, 19, 20:
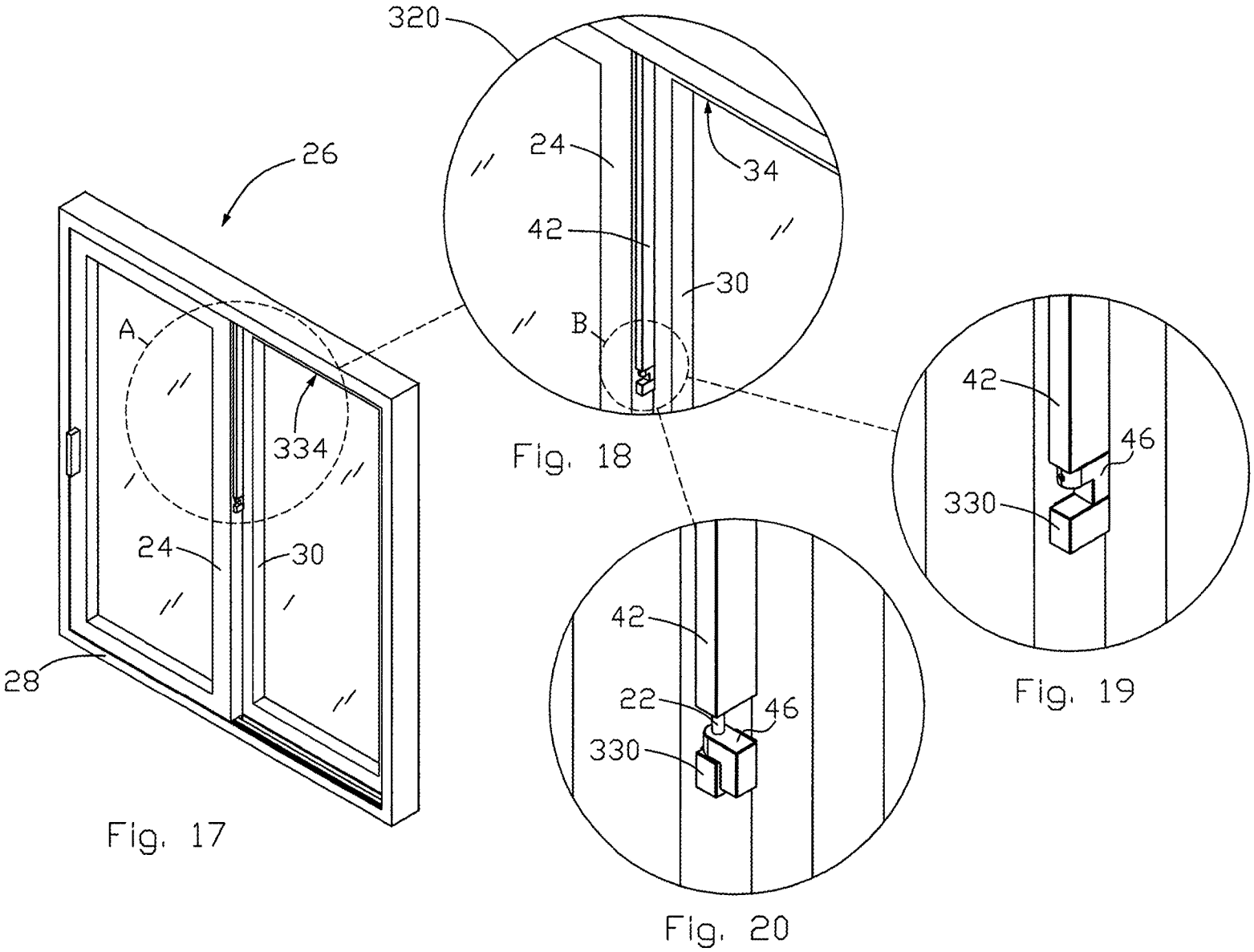
FIG. 17 is a perspective view of a fourth embodiment of the invention.
FIG. 18 is a perspective view of Section A in FIG. 17.
FIG. 19 is a perspective view of Section B in FIG. 18 in a locked position.
FIG. 20 is a perspective view of Section B in FIG. 18 in an unlocked position.

FIGS. 17-25 show a fourth embodiment of door stop mechanism 320. While most of the parts are similar to that of the other embodiments, the fourth embodiment 320 is inverted. The stop bar 34 is placed and attached to the inside top 334 of the frame 28, preferably using fasteners 344. As shown in FIG. 17, even though inverted, the door stop mechanism still maintains the convenient height of the other embodiments.

Figure 22:
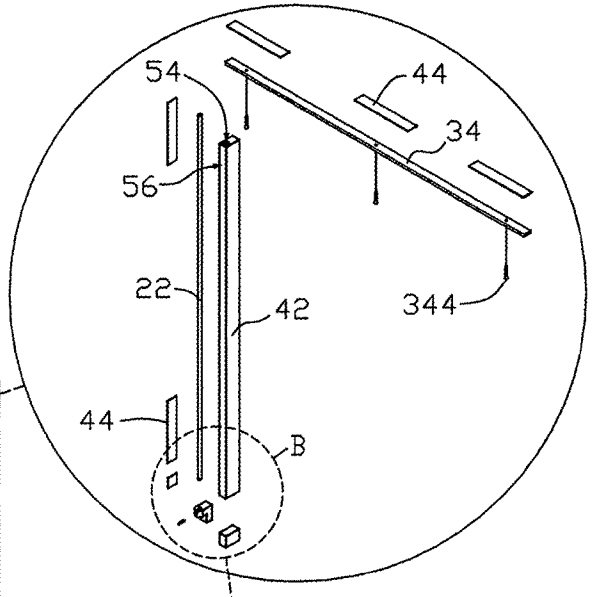
FIG. 22 is an exploded view of Section A of FIG. 21.
Figure 23:
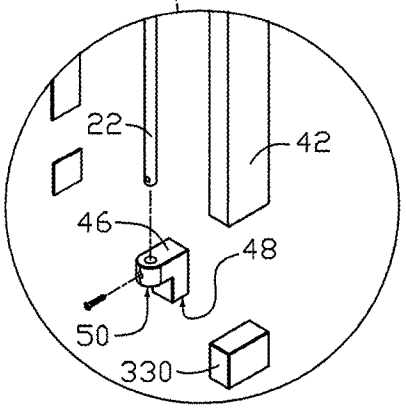
FIG. 23 is an exploded view of Section B of FIG. 22.
Figure 21:
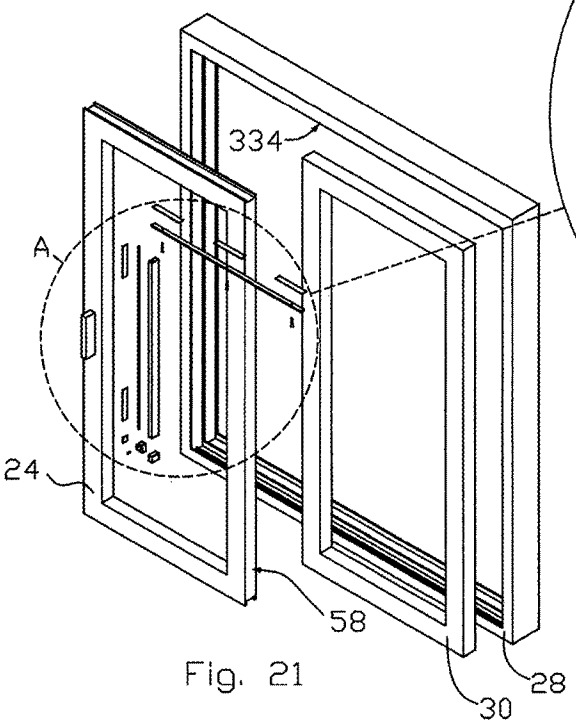
FIG. 21 is an exploded view of the fourth embodiment.

As shown in the exploded view of FIG. 22, the stop bar 34 is attached via fasteners 344 to the inside top 334 of the frame 28. As with the other embodiments, the fourth embodiment of the door stop mechanism 320 comprises mostly the same parts as the first embodiment. In the fourth embodiment, however, the second end 36 of the stop rod 22 is near the top of the frame rather toward the lower track. Additionally, the fourth embodiment comprises a stop block 330 that is mounted on the sliding member 24 as shown in FIGS. 19 and 20.

Figure 25:
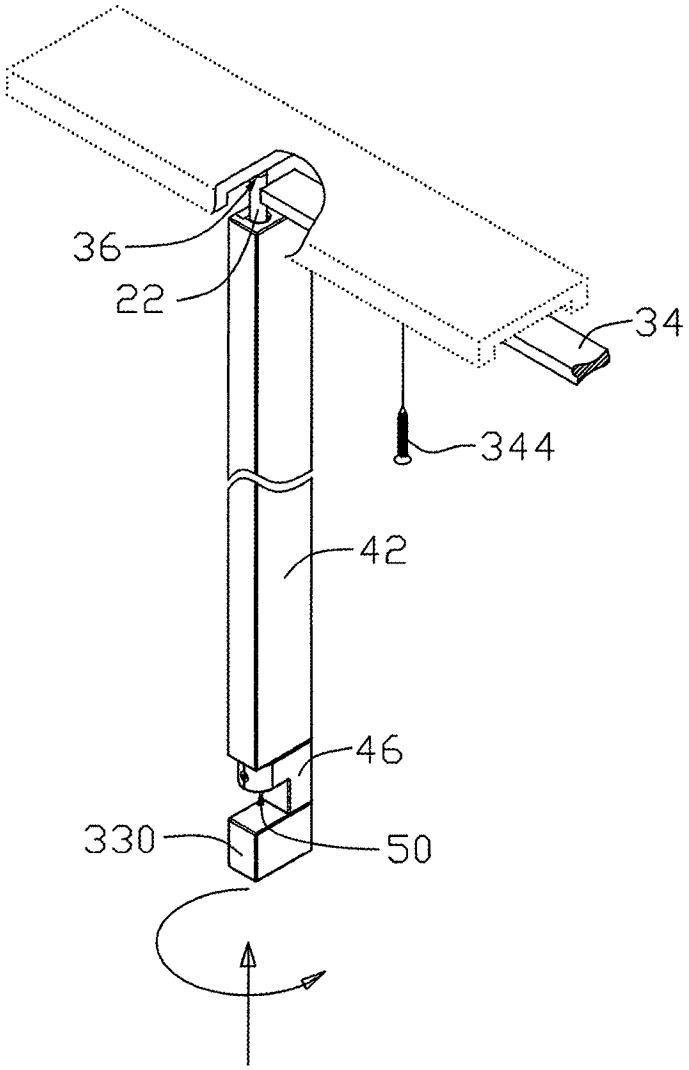
FIG. 25 is a perspective view of the fourth embodiment in a locked position.
Figure 24:
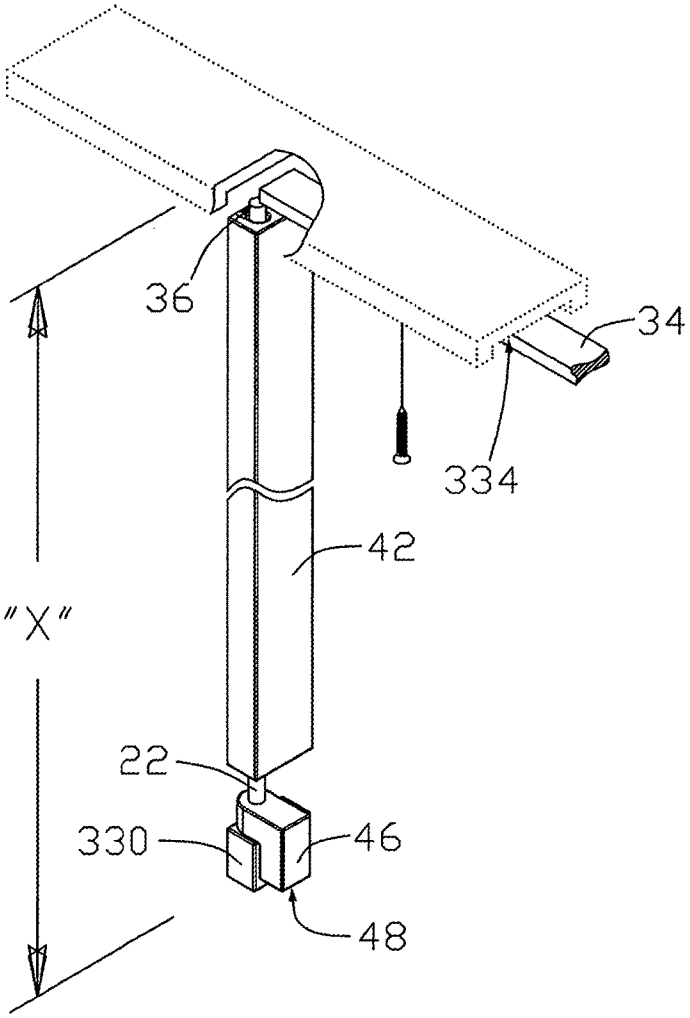
FIG. 24 is a perspective view of the fourth embodiment in an unlocked position.

In operation, the fourth embodiment 320 can go from the unlocked position shown in FIG. 20 to the locked position shown in FIG. 19, and vice versa, by manipulation of the rod actuator 46. In the unlocked position, the second end 36 can slide under the stop bar 34 as shown in FIG. 24. The rod actuator 46 is in a lowered position, preferably with the second surface 50 in contact with the stop block 330. In order to lock the fourth embodiment 320, the rod actuator 46 is pushed upward and then rotated as shown in FIG. 25. Now the first surface 48 is in contact with the stop block 330. Accordingly, the stop rod 22 is raised and the second end now cannot slide passed the stop bar 34.

In all the embodiments, a spring can be added on the stop rod 22 in order to increase the amount of pressure that is needed to move the embodiment from the locked to the unlocked position. While not needed for the basic functioning of the embodiment, the addition of the spring can make the embodiment more child proof.

Figure 32:
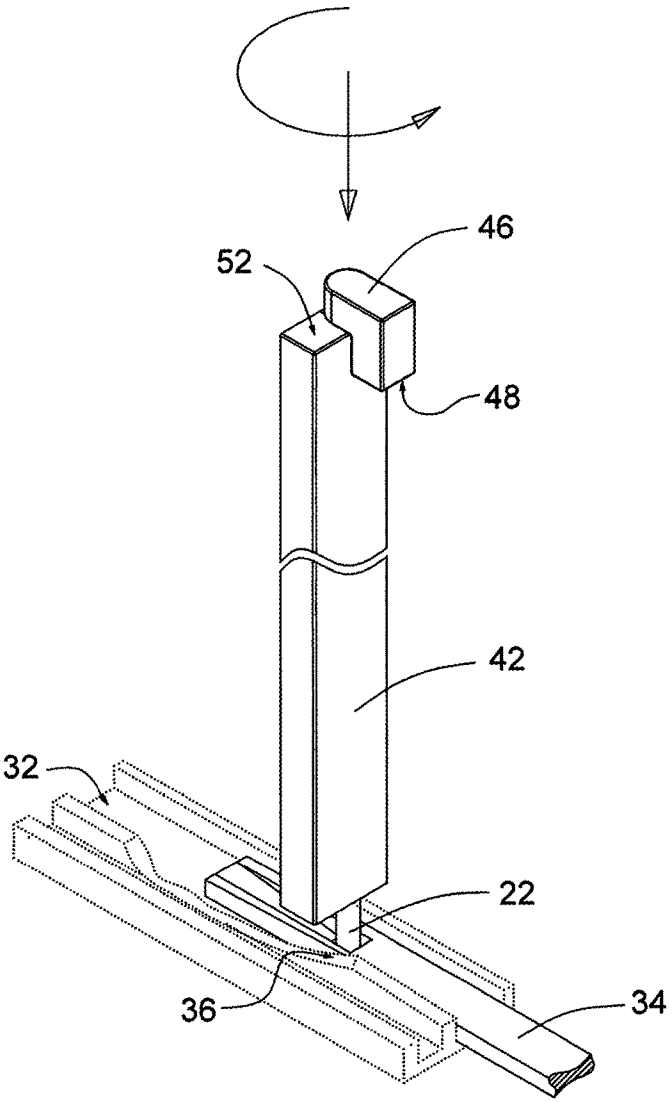
FIG. 32 is a perspective view showing a stop bar in the recess such that the sliding member can be in a partially open position.
Figure 31:
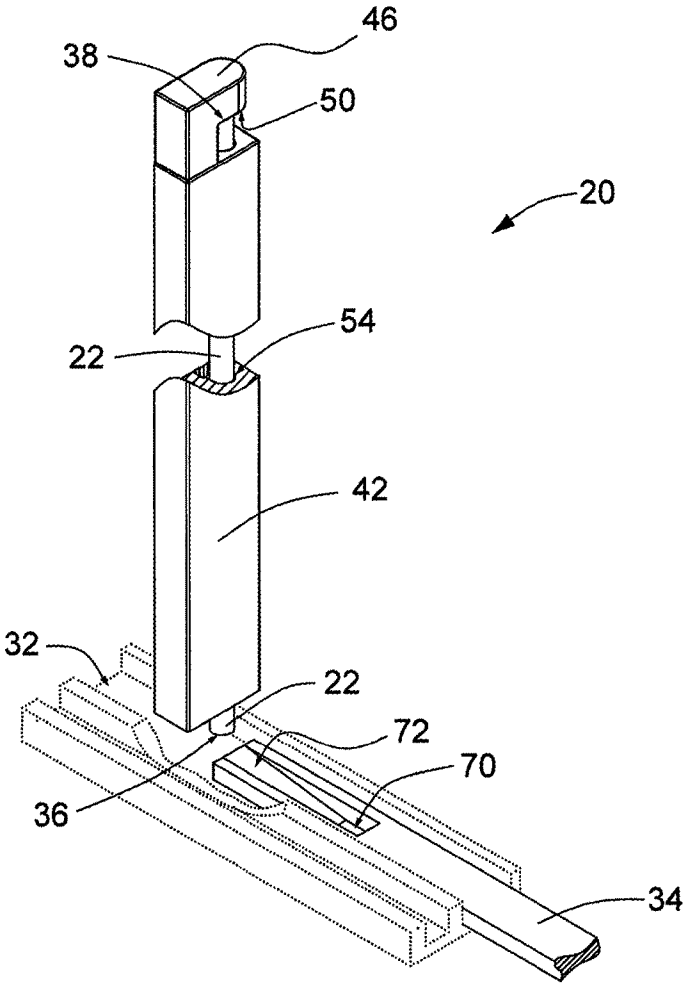
FIG. 31 is a perspective view showing a stop bar with a ramp and recess and the door stop mechanism is in an unlocked position.

FIGS. 29-32 show additions to the stop bar 34 such that a partially open position for the sliding member 24 can be achieved. As described previously, one or more openings 62 can be located on the stop bar 34. As the stop rod 22 glides above the stop bar 34 while in an unlocked position, the user can then manipulate the rod actuator 46 to a locked position such that the second end 36 of the rod 22 is positioned in the opening 62. If the user wants to open the sliding member 24 totally, the user lifts and rotates the rod actuator 46 and continues pushing the sliding member 24. FIGS. 31 and 32 show an alternate to the opening 62, and instead use a ramp 72 that ends in a recess 70. The benefit of the ramp is that the sliding member 24 can be pushed closed when the rod 22 is in the recess 70 without manipulation of the rod actuator 46. Additionally, a rotation stop 90 as shown in FIG. 7 can be attached to the frame 28 or sliding member 24 to inhibit rocking of the sliding member 24 of the patio door.

Having thus described the invention in connection with the several embodiments thereof, it will be evident to those skilled in the art that various revisions can be made to the several embodiments described herein with out departing from the spirit and scope of the invention. It is my intention, however, that all such revisions and modifications that are evident to those skilled in the art will be included with in the scope of the following claims. Any elements of any embodiments disclosed herein can be used in combination with any elements of other embodiments disclosed herein in any manner to create different embodiments.

What is claimed is:

1. A door stop mechanism for a sliding door, the sliding door having a frame, a sliding member, a stationary member and a track, the door stop mechanism comprising:

a stop rod configured to be selectively attachable to the sliding member;

a stop bar configured to bepositioned within the track;

the stop rod having a first end and a second end;

the stop rod movable from a first position to a second position;

wherein the stop bar is configured to prevent movement of the sliding member when the stop rod is in the second position;

wherein the stop rod is configured to allow movement of the sliding member above the stop bar when the stop rod is in the first position;

a stop body at least partially housing a portion of the stop rod;

a stop rod actuator provided on the first end of the stop rod, the stop rod actuator moveable between a first position and a second position, wherein the stop rod actuator has a first surface and a second surface;

wherein the stop rod pulled upwardly toward the first position, the first surface is in contact with the stop body maintaining the stop rod in the first position;

wherein, when the stop rod is rotated from the first position, the stop rod is moved downwardly allowing the second surface to contact the stop body and maintaining the stop rod in the second position.

2. The door stop mechanism of claim 1, wherein:

the first surface is parallel to the second surface.

3. The door stop mechanism of claim 1, wherein:

gravity maintains the stop rod in the second position.

4. The door stop mechanism of claim 1, wherein:

the stop bar has a first opening on a top of the stop bar;

wherein the stop rod can be positioned in the first opening.

5. The door stop mechanism of claim 1, wherein:

a height taken from the stop bar to the first end of the stop rod is between fifteen and seventy-three inches.

6. A door stop mechanism for a sliding door, the sliding door having a frame, a sliding member, a stationary member and a track, the door stop mechanism comprising:

a stop housing attachable to a side of the sliding member;

a stop rod configured to be selectively movable within the stop housing;

a stop bar comprising a connecting structure configured to be attached to the stop rod;

the stop rod movable from a first position to a second position, moving;

the stop bar from a first position to a second position;

wherein the stop rod is configured to move the stop bar away from the track, preventing movement of the sliding member by positioning the stop bar between the frame and the sliding member when the stop rod is in the second position and the stop bar is in the second position; and wherein the stop bar is configured to move the stop bar within the track, so that the connecting structure allows movement of the sliding member when the stop rod is in the first position and the stop bar is in the first position.

7. The door stop mechanism of claim 6, further comprising:

a stop body;

the stop body housing at least partially housing a portion of the stop rod.

8. The door stop mechanism of claim 7, wherein;

the stop bar has a channel on a top of the stop bar;

wherein the stop rod can be positioned in the channel;

the stop rod pulls the stop bar upward in the second position of the stop rod.

9. The door stop mechanism of claim 8, further comprising:

a stop rod actuator;

the stop rod actuator on a first end of the stop rod.

10. The door stop mechanism of claim 9, wherein:

the stop rod actuator has a first position and a second position;

the stop rod actuator movable from the first position to the second position;

movement of the stop rod actuator results in movement of the stop rod.

11. The door stop mechanism of claim 10, wherein;

the stop rod actuator has a first surface and a second surface;

the first surface in contact with the stop body when the stop rod is in the second position.

12. The door stop mechanism of claim 11, wherein:

the second surface is in contact with the stop body when the stop rod is in the first position.

13. The door stop mechanism of claim 6, wherein:

gravity maintains the stop rod in the second position.

14. The door stop mechanism of claim 6, wherein:

a height taken from the stop bar to the first end of the stop rod is between fifteen and seventy-three inches.

15. A door stop mechanism for a sliding door, the sliding door having a frame, a sliding member, a stationary member and a track, the door stop mechanism comprising:

a stop rod configured to be selectively attachable to the sliding member;

a stop bar configured to be positioned within the track;

the stop rod having a first end and a second end;

the stop rod movable from a first position to a second position;

wherein the stop bar is configured to prevent movement of the sliding member when the stop rod is in the second position;

wherein the stop rod is configured to allow movement of the sliding member when the stop rod is in the first position;

the stop rod is movable above the stop bar when the stop rod is in the first position;

a stop body at least partially housing a portion of the stop rod;

a stop rod actuator provided on the first end of the stop rod, the stop rod actuator moveable between a first position and a second position, wherein the stop rod actuator has a first surface and a second surface;

wherein the stop rod pulled upwardly toward the first position, the first surface is in contact with the stop body maintaining the stop rod in the first position;

wherein, when the stop rod is rotated from the first position, the stop rod is moved downwardly allowing the second surface to contact the stop body and maintaining the stop rod in the second position;

a secondary rod actuator moves the stop rod actuator.

16. The door stop mechanism of claim 15, wherein:

the secondary rod actuator is controlled via a remote module.

* * * * *